US005311953A

United States Patent [19]

Walker

[11] Patent Number: 5,311,953

[45] Date of Patent: May 17, 1994

[54] DRILL BIT STEERING

[75] Inventor: Colin Walker, Winster, England

[73] Assignee: Baroid Technology, Inc., Houston, Tex.

[21] Appl. No.: 926,912

[22] Filed: Aug. 7, 1992

[51] Int. Cl.[5] ..... E21B 7/06

[52] U.S. Cl. ..... 175/61; 175/73; 175/107; 175/325.1

[58] Field of Search ..... 175/61, 62, 74, 75, 175/73

[56] References Cited

U.S. PATENT DOCUMENTS

| | | | |
|---|---|---|---|
| 3,627,356 | 12/1971 | Anderson . | |
| 3,717,208 | 2/1973 | Anderson | 175/74 |
| 4,076,084 | 2/1978 | Tighe | 175/61 |
| 4,394,881 | 7/1983 | Shirley | 175/76 |
| 4,407,377 | 10/1983 | Russell . | |
| 4,491,187 | 1/1985 | Russell . | |
| 4,501,336 | 2/1985 | Kemp et al. | 175/61 |
| 4,572,305 | 2/1986 | Swietlik . | |
| 4,754,821 | 7/1988 | Swietlik . | |
| 4,821,817 | 4/1989 | Cendre . | |
| 4,844,178 | 7/1989 | Cendre et al. . | |
| 4,848,488 | 7/1989 | Cendre . | |
| 4,848,490 | 7/1989 | Anderson . | |
| 4,862,974 | 9/1989 | Warren et al. | 175/61 |
| 4,928,776 | 5/1990 | Falgout, Sr. | 175/73 |
| 4,951,760 | 8/1990 | Cendre et al. . | |
| 5,033,556 | 7/1991 | Panzke | 175/62 |
| 5,139,094 | 8/1992 | Prevedel et al. | 175/61 |
| 5,154,243 | 10/1992 | Dudman | 175/75 |

FOREIGN PATENT DOCUMENTS

| | | |
|---|---|---|
| 0085444 | 2/1985 | European Pat. Off. . |
| 0103913 | 10/1986 | European Pat. Off. . |
| 0109699 | 12/1986 | European Pat. Off. . |
| 0409446 | 1/1991 | European Pat. Off. . |

OTHER PUBLICATIONS

WO/9108370, Johannes Van Den Bergh, et al., Device for Steering the Foremost Part of a Drill Pipe, Jun. 13, 1991.

WO/92/09783, Robert Appleton, Apparatus for Directional Drilling, Jun. 11, 1992.

*Primary Examiner*—Ramon S. Britts
*Assistant Examiner*—Frank S. Tsay
*Attorney, Agent, or Firm*—Browning, Bushman, Anderson & Brookhart

[57] ABSTRACT

For steering a drill bit, a trajectory control sub has a lower part adjustable relative to the upper part to produce an axial bend to angularly offset the drill bit so that drilling proceeds along a curved path. Adjustable stabilizer blades are mounted on the sub and are movable between extended positions and retracted positions. An actuator is provided which selectively maintains the drill bit in axial alignment with the section of borehole being drilled, and which is actuable to move the blades into their retracted positions and subsequently, with the blades in their retracted positions, to effect tilting of the lower part relative to the upper part to produce the axial bend leading to tilting of the drill bit.

33 Claims, 3 Drawing Sheets

DRILL BIT STEERING

BACKGROUND OF THE INVENTION

This invention relates to the steering of a drill bit at the end of a drill string within a borehole to permit drilling of the borehole along a deviated path.

It is known to drill a section of borehole along a deviated path with respect to the vertical by use of a downhole trajectory control device which causes the drill bit located at the end of the drill string to be tilted to permit drilling at an inclined angle with respect to the immediately preceding section of the borehole. Such a trajectory control device may be constituted by a bent sub or a bent motor housing which may be installed in the bottomhole assembly close to the drill bit so as to angularly offset the drill bit so that, when the drill string is maintained at a required angular orientation, rotation of the drill bit by a downhole motor results in drilling along a curved path.

Conventionally, when drilling is to be initiated along a deviated path, the drill string is withdrawn from the borehole to enable a bottomhole assembly incorporating a bent sub or bent motor housing to be fitted to the end of the drill string before the drill string is again introduced into the borehole. However such tripping of the drill string may result in a substantial loss of drilling time.

It is also known to make use of a trajectory control device, such as a variable angle bent sub, which is adapted to permit the curvature of the section of deviated borehole being drilled, that is the so-called "build rate", to be varied without requiring the drill string to be withdrawn from the borehole to change the bottomhole assembly. Such a variable angle bent sub is disclosed in GB 1494273 and is controllable from the surface to vary the angle of the bend in the sub.

It is also known to make use of a trajectory control device in the form of a variable stabilizer, such as is disclosed in U.S. Pat. No. 4821817, in which equiangularly distributed stabilizer blades, which normally engage the borehole wall in order to centre the drill string within the borehole, are retractable in order to permit the drilling angle of the drill bit to be changed. Control of such a trajectory control device may be effected by operation of the mud pump at the surface to change the flow rate of the drilling mud which is pumped down the borehole to lubricate the drill bit and bring the drilling cuttings to the surface.

However these various trajectory control devices suffer from a number of disadvantages in use, either because they are difficult to control and do not operate satisfactorily in the field, or because they suffer from inherent limitations in use. Thus, for example, the use of a bent motor housing suffers from the disadvantage that, in order to drill a relatively straight section of borehole with a bottomhole assembly including such a bent motor housing, it is necessary to simultaneously rotate the drill string and actuate the downhole motor, and this results in eccentric rotation of the drill bit producing a section of borehole (of, it is believed, helical shape) of a greater internal diameter than is usual, thus increasing bit wear, producing higher static and dynamic stresses in the bottomhole assembly and increasing drill string rotating torque and axial drag.

In this specification terms such as "upper", "lower" and "bottom" are used for convenience to denote parts which have such an orientation in the drill string when the drill string extends substantially vertically downwardly in a borehole. However it will be understood that these parts may have a different orientation when the bottomhole assembly is in a section of borehole which deviates substantially from the vertical, and which may even be substantially horizontal.

It is an object of the invention to provide novel means for steering the drill bit which overcomes many of the disadvantages of known trajectory control devices.

SUMMARY OF THE INVENTION

According to the present invention there is provided apparatus for steering a drill bit at the end of a drill string within a borehole to permit drilling of the borehole along a deviated path, the apparatus comprising a tubular body having an upper part adapted at its upper end to be coupled to a lower portion of the drill string and a lower part adapted at its lower end to be coupled to a lower assembly including the drill bit, the lower part being adjustable relative to the upper part to produce an axial bend in the tubular body between the two parts, adjustable stabilizer blades mounted on the tubular body and movable between extended positions in which the blades engage the borehole wall and retracted positions in which the blades are radially spaced from the borehole wall, and actuating means for tilting the drill bit out of a position in which it is maintained in axial alignment with the section of borehole being drilled by axial alignment of the two parts of the tubular body and engagement of the borehole wall by the stabilizer blades, actuation of the actuating means resulting in movement of the stabilizer blades into their retracted positions and subsequently, with the stabilizer blades in their retracted positions, tilting of the lower part relative to the upper part to produce an axial bend in the tubular body leading to tilting of the drill bit.

The above described arrangement is advantageous in that it first creates sufficient radial clearance between the drill string and the surrounding borehole wall by retraction of the stabilizer blades, and only then induces a bend in the tubular body in such a manner as to avoid creation of massive bending moments in the vicinity of the point of bending. The advantages of combining these two actions in a serial manner has not previously been appreciated, and such a technique can be carried out without the necessity to withdraw the drill string from the borehole to change the bottomhole assembly. It is also an advantage of such an arrangement that, when it is desired to drill a straight section of borehole, the drill bit is simply located in its untilted position in which it is maintained in axial alignment with the section of borehole being drilled, with the result that the drill bit drills a straight section of borehole of normal cross-section with significantly decreased drill string rotating torque and axial drag as compared with certain prior arrangements. In use of such an arrangement the life of the drilling motor tends to be extended, particularly since the drive coupling does not necessarily have to pass through a bend in the housing of the motor.

The invention also provides a method of steering a drill bit at the end of a drill string within a borehole to permit drilling of the borehole along a deviated path, the method comprising connecting a tubular stabilizer body within the drill string so that an upper part of the tubular body is coupled to a lower portion of the drill string and a lower part of the tubular body is coupled to a lower assembly including the drill bit, lowering the drill string into position within the borehole so that the drill bit is located at the bottom of the borehole in axial alignment with the section of borehole being drilled with the two parts of the tubular body being axially aligned and centred within the borehole by stabilizer blades on the body engaging the borehole wall, retracting the stabilizer blades so that they no longer engage the borehole wall, and, with the stabilizer blades in their retracted positions, tilting the lower part relative to the upper part to produce an axial bend in the tubular body between the two parts resulting in tilting of the drill bit to permit drilling along a deviated path.

BRIEF DESCRIPTION OF THE DRAWINGS

In order that the invention may be more fully understood, a preferred embodiment of the invention will now be described, by way of example, with reference to the accompanying drawings, in which.

DETAILED DESCRIPTION OF THE DRAWINGS

Figure 1:
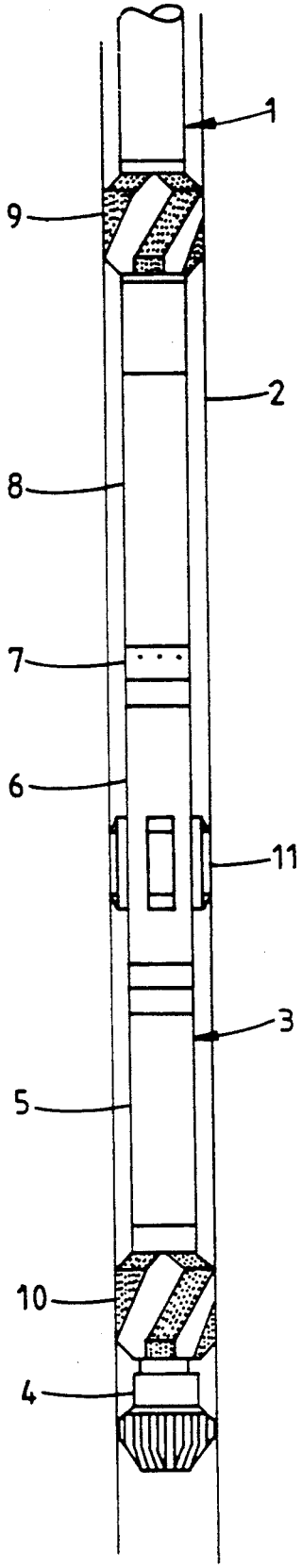
FIGS. 1 and 2 are side views of the apparatus within a borehole in the straight drilling mode and the deviated drilling mode respectively.

Referring to FIG. 1 a drill string 1 within a borehole 2 has a bottom hole assembly 3 comprising a drill bit 4, a drilling motor 5 for rotating the drill bit, a trajectory control sub 6, a bypass sub 7 and a measurement-while-drilling (MWD) tool 8 incorporating downhole sensors and means for transmitting data to the surface such as a mud pulse transmitter. It will be appreciated that various types of drill bit, drilling motor, downhole sensor and transmitting means can be used in such a downhole assembly, but these will not be discussed further here as they are not central to the inventive concept.

Optionally the bottomhole assembly 3 may include upper and lower stabilizers 9 and 10 for centring the assembly within the borehole 2. If required both the upper stabilizer 9 and the MWD tool 8 may be placed higher up the bottomhole assembly than is shown. If the lower stabilizer 10 is not provided the drill bit 4 may instead be provided with a long gauge section (not shown).

The trajectory control sub 6 is shown in FIG. 1 in a straight drilling mode in which equiangularly spaced stabilizer blades 11 on the sub 6 are in radially extended positions engaging the wall of the borehole 2 so as to centre the sub 6 within the borehole and in which the whole of the bottomhole assembly 3 including the sub 6 is in axial alignment with the section of the borehole being drilled so that further drilling of the borehole by rotation of the drill bit 4 will result in drilling along a straight path. Typically the gauge diameters of the blades of the upper and lower stabilizers 9 and 10 and of the stabilizer blades 11 on the sub 6 are arranged before running into the borehole with the intention that, when mud pumping along the drill string commences and the drilling motor 5 turns the drill bit 4, rotation of the drill string and the application of weight to the bit causes the entire assembly to drill ahead along a constant trajectory (constant inclination I and azimuth A).

Figure 2:
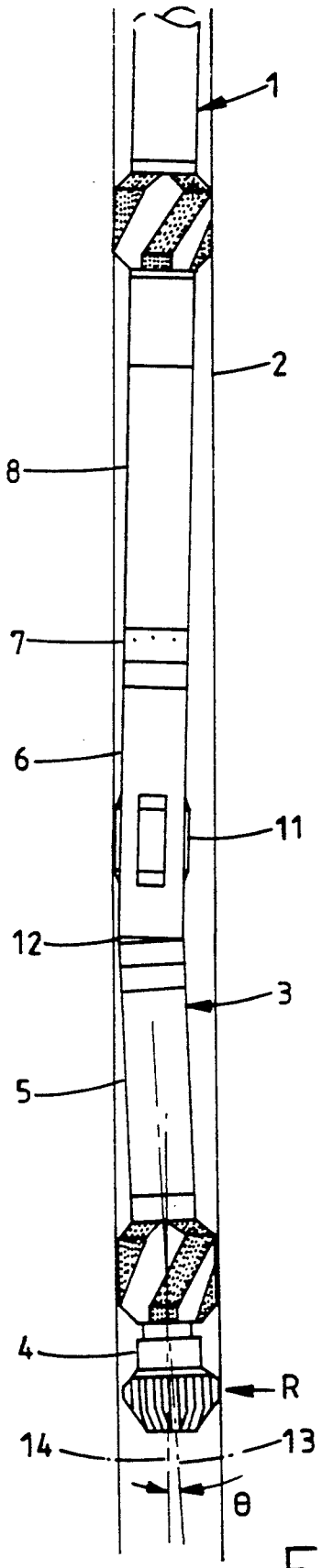

On the other hand the trajectory control sub 6 is shown in FIG. 2 in a deviated drilling mode in which the stabilizer blades 11 are in radially retracted positions in which they are spaced from the wall of the borehole 2 so as to provide radial clearance about the sub 6 and in which a bend 12 is induced in the part of the sub 6 below the stabilizer blades 11 so as to provide an angular offset Θ between the axis 13 of rotation of the drill bit 4 and the centre line 14 of the borehole. Such tilting of the drill bit 4 causes the bit to be forced against the borehole wall on the side to which it is angularly offset resulting in a reaction force R. Accordingly rotation of the drill bit 4 by the drilling motor 5 will result in drilling along a deviated path, and more particularly along a curved path having a radius of curvature determined by the offset angle Θ.

In practice changing from the straight drilling mode to the deviated drilling mode may be made by a series of steps in response to detection of departure of the inclination I from the required value or the azimuth A from the desired direction. These steps comprise stopping of drill string rotation followed by, in a first actuation phase, retraction of the stabilizer blades 11 and, in a second actuation phase, creation of the bend 12 in the sub 6. Since the orientation of the sub 6 relative to the MWD tool 8 has been established prior to running into the borehole, the drilling motor 5 may then be oriented in the required azimuthal direction, and the appropriate trajectory change may then be effected by actuation of the drilling motor 5 for the required length of time. Subsequently changing from the deviated drilling mode back to the straight drilling mode is effected in the reverse sequence with the second actuation phase to reduce the bend to zero preceding the first actuation phase to extend the stabilizer blades.

It is important that the first and second phases of actuation of the trajectory control sub 6 occur sequentially as this then ensures that sufficient radial clearance is created prior to forming of the bend, and thus avoids massive bending moments, and therefore stresses, at and about the point of bending.

The operation of the trajectory control sub 6 will now be described in greater detail with reference to FIGS. 3, 4 and 5 which show three successive phases of operation of the sub 6 starting with the straight drilling position shown in FIG. 3.

Figure 3:
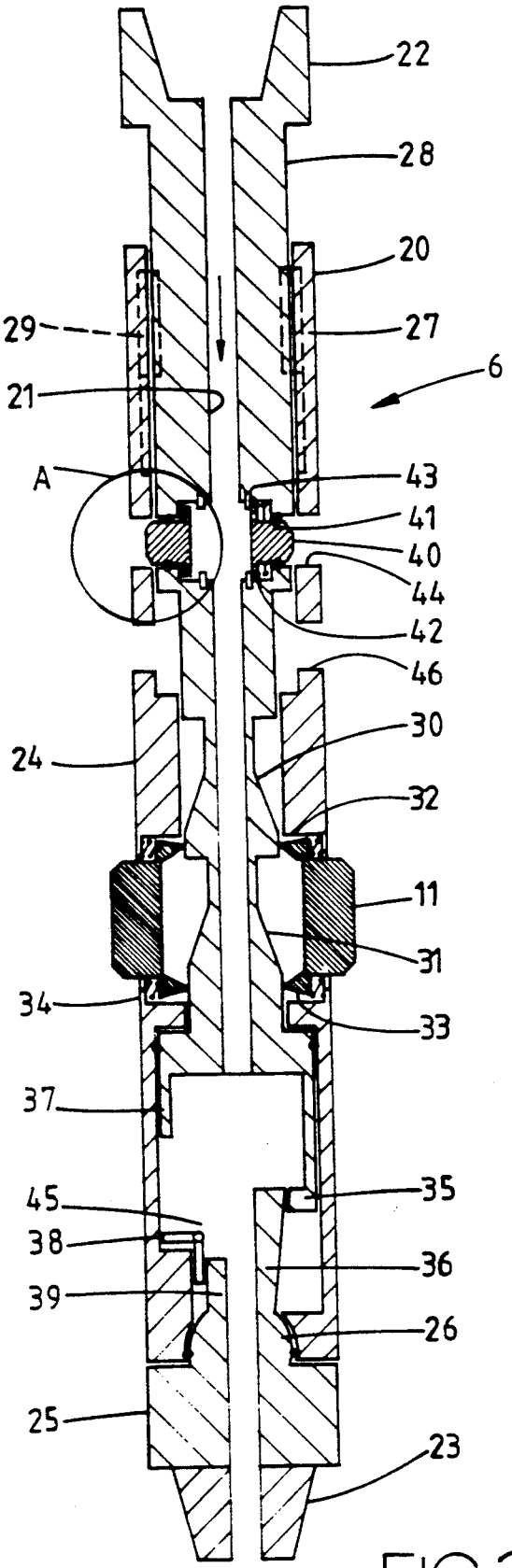
FIGS. 3, 4 and 5 are axial sections through the apparatus in three successive operating positions.
Figure 4:
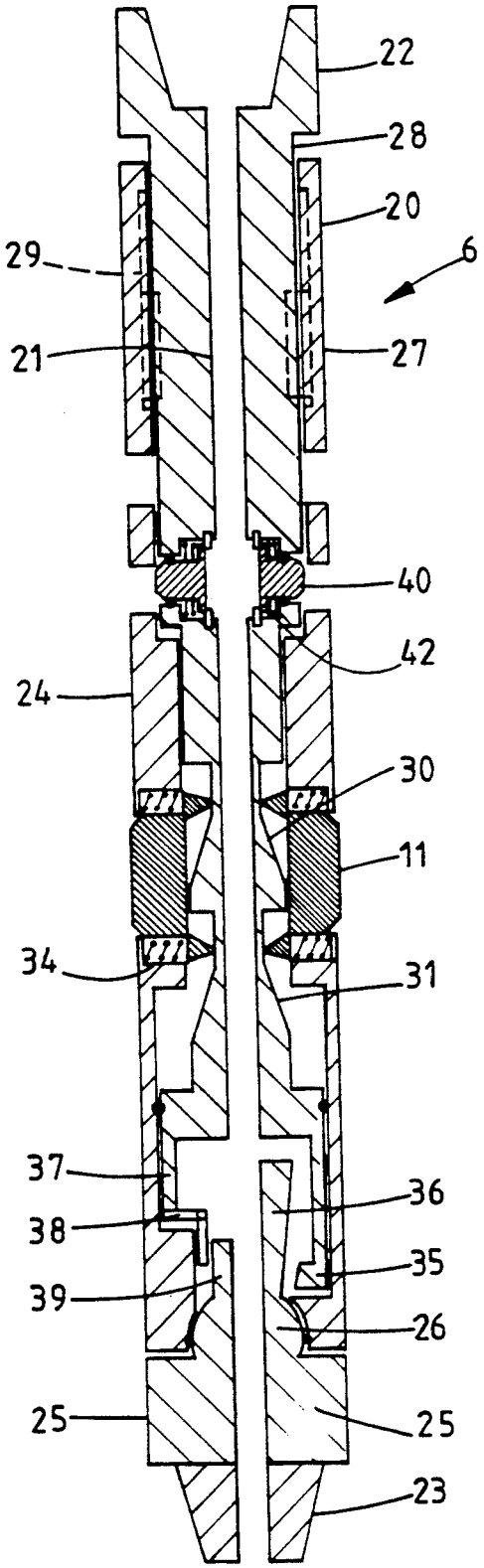

Referring to FIG. 3 the sub 6 has a tubular body 20 having an axial bore 21 for passage of drilling mud and consisting of an upper part 24 having a female coupling 22 at its upper end for connection to an adjacent sub and a lower part 25 having a male coupling 23 at its lower end for connection to an adjacent sub. The upper and lower body parts 24 and 25 are coupled together by a single axis knuckle joint 26 capable of producing an axial bend between the two parts. The upper part 24 has a housing 27 and a mandrel 28 coaxially located within the housing and drivingly engaged with the housing by drive splines 29 (shown by broken lines in the drawings). The mandrel 28 has annular camming surfaces 30 and 31 engaged by two feet 32 and 33 on each of the stabilizer blades 11 under the action of return springs 34.

The camming surfaces 30 and 31 maintain the blades 11 in their extended positions in the axial position of the mandrel 28 shown in FIG. 3. Furthermore, in this position, a locking wedge 35 on the mandrel 28 acts against a long lever arm 36 on the knuckle joint 26 to maintain the parts 24 and 25 in axial alignment, an actuating rod 37 on the mandrel 28 being spaced from a pivot member 38 which is in contact with a short lever arm 39 on the knuckle joint 26 (and which serves to effect pivoting of the knuckle joint as will be described in more detail below).

Furthermore the sub 6 includes two locking pistons 40 each of which is held in position in a respective radial bore 41 in the wall of the mandrel 28 by a retaining ring 43 and is movable radially outwardly by mud pressure against the action of a spring 42 in order to engage within a recess in the wall of the housing 27 to lock the mandrel 28 axially in position relative to the housing 27. For the purposes of illustration only, the locking piston 40 on the right hand side of FIG. 3 is shown in the unactuated position and the other locking position 40 at A on the left hand side of FIG. 3 is shown in the actuated position in which the pressure P of the drilling mud flowing downwardly within the bore 21 is greater than a threshold value $P_T$ determined by the preload on the spring 42 and the surface area A of the inner face of the piston 40. It will be understood that in practice both pistons 40 will be either in the unactuated position or in the actuated position at any one time.

In operation, in order to effect drilling along a straight path, the pump rate of the mud pump at the surface is first set so that the mud pressure is less than $P_T$, and the drill string is then slowly hoisted within the borehole to ensure that the mandrel 28 is at its uppermost position within the housing 27. The pump rate is then increased to the drilling flow rate at which the mud pressure P is greater than $P_T$, and this results in actuation of the locking pistons 40 to engage within recesses 44 in the wall of the housing 27 so as to axially fix the mandrel 28 in its uppermost position relative to the housing 27 as shown in FIG. 3. The drill string may then be lowered to the bottom of the borehole and rotation of the drill string started to commence drilling along a straight path.

In order to change to drilling along a deviated path, rotation of the drill string is stopped and the drill string is hoisted to raise the drill bit from the bottom of the borehole. The pump rate is then reduced so that the mud pressure is less than $P_T$ resulting in movement of the locking pistons 40 by the springs 42 into their unactuated positions as shown in FIG. 4, and the drill bit is lowered to the bottom of the borehole and weight applied so that, in a first actuation phase, the mandrel 28 moves downwardly within the housing 27 and the camming surfaces 30 and 31 on the mandrel 28 are moved to permit the stabilizer blades 11 to be retracted by the springs 34. At the same time the locking wedge 35 is moved downwardly and away from the long lever arm 36 on the knuckle joint 26.

Figure 5:
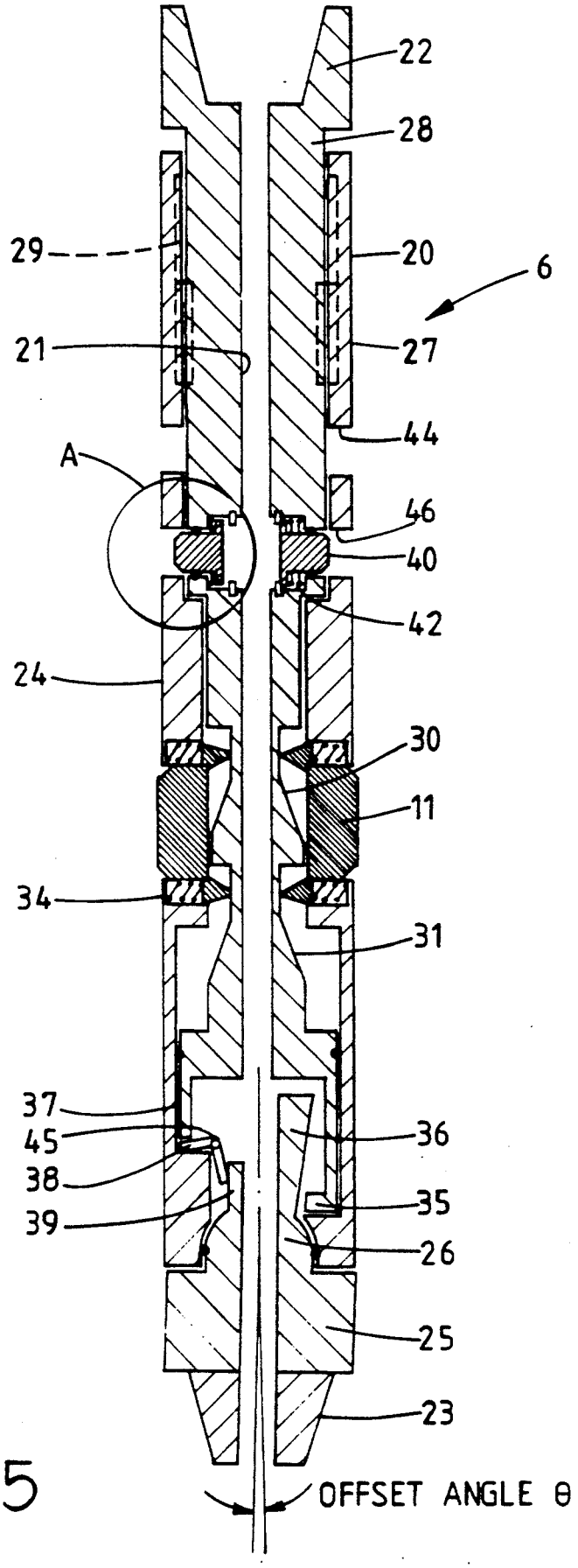

With continued application of weight to the drill bit, the mandrel 28 continues to move downwardly within the housing 27 so that, in a second actuation phase following the first actuation phase, the actuating rod 37 on the mandrel 28 contacts the pivot member 38 and causes it to pivot about its pivot point 45 which in turn acts on the short lever arm 39 to cause pivoting of the knuckle joint 26 through the offset angle $\Theta$ to produce the required bend in the sub 6, as shown in FIG. 5. The pump rate is then slowly increased to the drilling rate so that the mud pressure is greater than $P_T$ with the result that the locking pistons 40 are actuated so as to engage within recesses 46 in the wall of the housing 27 as shown at A on the left hand side of FIG. 5. This causes the mandrel 28 to be locked in its lowermost position relative to the housing 27. The drilling motor may then be oriented at the required azimuthal angle and deviated drilling commenced.

When the drill bit is lowered to the bottom of the borehole and weight applied, the motor will develop a differential pressure $P_D$, so that, if the mud pressure when the bit is off the bottom is $P_o$, the sum $P_o+P_D$ must be less than the threshold value $P_T$ or the locking pistons 40 may attempt to actuate before they come into direct alignment with the recesses 46 in the housing wall.

The above-described trajectory control sub is particularly advantageous in use as, during drilling by drill string rotation in the zero-bend condition (shown in FIG. 3), the drill bit is rotated concentrically and therefore drills a standard gauge hole. Furthermore, because eccentric rotation of the drill bit is not required in this mode, drill string rotating torque and drag are decreased as compared with arrangements in which the drill bit is rotated eccentrically by drill string rotation. Furthermore changing to the deviated drilling mode can be accomplished without tripping of the drill string.

Although the above description has been given with reference to one specific embodiment in accordance with the invention, it will be appreciated that a number of other embodiments in accordance with the invention are also contemplated. For example, embodiments are contemplated in which the actuating movement of the mandrel is rotary rather than linear, and/or in which the mandrel is actuated electrically or hydraulically. Embodiments are also contemplated in which the locking pistons are dispensed with and replaced by some other actuating arrangement, and/or in which some other arrangement is provided for forming the bend, either by being actuated by the mandrel or by being separately actuated such as by a synchronized control system.

What is claimed is:

1. Apparatus for steering a dill bit at the end of a drill string within a borehole to permit drilling of the borehole along a deviated path, the apparatus comprising:

a tubular body having an upper part adapted at its upper end to be coupled to a lower portion of the drill string and a lower part adapted at its lower end to be coupled to a lower assembly including the drill bit, the lower part being pivotable relative to the upper part to produce an axial bend in the tubular body between the upper and lower parts;

upper and lower stabilizers on the respective upper and lower parts of the tubular body to center the tubular body within the borehole;

adjustable stabilizer blades mounted on the tubular body and radially movable between extended positions in which the blades engage the borehole wall, and retracted positions in which the blades are radially spaced from the borehole wall; and an actuating member for selectively maintaining the lower part in axial alignment with the upper part and thereby maintaining the drill bit in axial alignment with a section of borehole being drilled while simultaneously maintaining the stabilizer blades in their extended positions and for selectively retracting the stabilizer blades to their retracted positions while causing the lower part relative to pivot relative to the upper part to produce an axial bend in the tubular body and thereby tilt the drill bit out of alignment with the section of borehole being drilled.

2. Apparatus as defined in claim 1, wherein the upper and lower parts are pivotably connected together by a knuckle joint for producing the axial bend between the two parts.

3. Apparatus as defined in claim 1, wherein the actuating means comprises a mandrel axially movable within the tubular body to effect retraction of the stabilizer blades and tilting of the lower part relative to the upper part.

4. Apparatus as defined in claim 3, further comprising:

biasing members for biasing the stabilizer blades radially inwardly; and camming surfaces on the mandrel for effecting radial movement of the stabilizer blades in response to axial movement of the mandrel relative to the tubular body.

5. Apparatus as defined in claim 3, further comprising:

a pivotable member;

the mandrel located within the upper part; and an actuating member for engaging the pivotal member to effect tilting of the lower part relative to the upper part in response to axial movement of the mandrel relative to the tubular body.

6. Apparatus as defined in claim 5, wherein the mandrel further comprises:

a locking wedge member adapted to selectively lock the lower part in axial alignment with the upper part and to selectively permit tilting of the lower part by the actuating device.

7. Apparatus as defined in claim 3, wherein the actuating means further comprises:

locking means movable into an unlocking position in response to pressure variation in drilling fluid within the drill string to permit relative axial movement between the mandrel and the tubular body.

8. Apparatus as defined in claim 7, further comprising:

the mandrel including a bore for the passage of drilling fluid; and the locking means comprises at least one locking piston extending through a wall of the mandrel between the bore and an outer surface of the mandrel, and at least one locking recess in a wall of the tubular part for receiving the at least one locking piston in a locking position.

9. A method of steering a drill bit at the end of a drill string within a borehole to permit drilling of the borehole along a deviated path, the method comprising:

(a) connecting an upper part of a tubular body to a lower portion of the drill string;

(b) connecting a lower part of the tubular body to a lower assembly including the drill bit;

(c) lowering the drill string into position within the borehole such that the drill bit is located at the bottom of the borehole;

(d) axially aligning the upper and lower parts of the tubular body within the borehole such that the drill bit is aligned with a section of the borehole immediately above the drill bit;

(e) moving a mandrel axially within the tubular body to a blade out position to move stabilizer blades on the upper part of the tubular body radially outward to engage the borehole wall;

(f) rotating the drill bit while the upper and lower parts of the tubular body are axially aligned and while the stabilizer blades are move radially outward to drill along substantially a straight path;

(g) thereafter retracting the stabilizer blades out of engagement with the borehole wall;

(h) with the stabilizer blades in their retracted positions, pivoting the lower part relative to the upper part to produce an axial bend in the tubular body between the upper and lower parts resulting in tilting of the drill bit; and (i) rotating the drill bit while the lower part is pivoted relative to the upper part to drill along a deviated path.

10. The method as defined in claim 9, further comprising:

prior to step (f), securing the stabilizer blades in their radially outward position relative to the tubular body.

11. The method as defined in claim 9, wherein the step of securing the mandrel comprises:

providing a radially movable piston carried by the mandrel; and increasing fluid pressure to the stabilizer body to move the piston radially out and interconnect the mandrel and the stabilizer body.

12. The method as defined in claim 9, further comprising:

performing step (d) prior to step (e).

13. The method as defined in claim 9, further comprising:

prior to step (g), discontinuing rotation of the drill bit.

14. The method as defined in claim 9, further comprising:

prior to step (i), securing the stabilizer blades in their radially inward position relative to the tubular body.

15. The method as defined in claim 9, wherein step (g) further comprises:

biasing the stabilizer blades in their radially retracted positions.

16. The method as defined in claim 9, wherein step (h) comprises:

applying weight on the drill bit through the drill string to pivot the lower part relative to the upper part.

17. The method as defined in claim 9, further comprising:

selectively rotating the drill string prior to step (i) to orient the bit in a desired direction.

18. A method of steering a drill bit at the end of a drill string within a borehole to permit drilling of the borehole along a deviated path, the method comprising:

(a) connecting an upper part of a tubular body to a lower portion of the drill string;

(b) connecting a lower part of the tubular body to a lower assembly including the drill bit;

(c) mounting radially movable stabilizer blades on the upper part of the tubular body;

(d) lowering the drill string into position within the borehole such that the drill bit is located at the bottom of the borehole;

(e) thereafter inwardly retracting the stabilizer blades out of engagement with the borehole wall;

(f) with the stabilizer blades in their retracted positions, pivoting the lower part relative to the upper part to produce an axial bend in the tubular body between the upper and lower parts resulting in tilting of the drill bit;

(g) selectively rotating the drill string to orient the bit in a desired direction; and (h) with the drill bit desirably oriented, rotating the drill bit while the lower part is pivoted relative to the upper part to drill along a deviated path.

19. The method as defined in claim 18, further comprising:

moving a mandrel axially within the tubular body to inwardly retract the stabilizer blades and to pivot the lower part relative to the upper part.

20. The method as defined in claim 18, further comprising:

mounting a plurality of stabilizer blades on the lower part of the tubular body.

21. The method as defined in claim 18, further comprising:

biasing the stabilizer blades radially inward; and selectively locking the stabilizer blades in their radially outward position.

22. Apparatus for steering a drill bit at the end of a drill string within a borehole to permit drilling of the borehole along a deviated path, the apparatus comprising:

a tubular body having an upper part adapted at its upper end to be coupled to a lower portion of the drill string and a lower part adapted at its lower end to be coupled to a lower assembly including the drill bit, the lower part being pivotable relative to the upper part to produce an axial bend in the tubular body between the upper and lower parts;

adjustable stabilizer blades mounted on the tubular body and radially movable between extended positions in which the blades engage the borehole wall, and retracted positions in which the blades are radially spaced from the borehole wall; and a mandrel axially movable within the tubular body for selectively maintaining the lower part in axial alignment with the upper part and thereby maintaining the drill bit in axial alignment with a section of borehole being drilled while simultaneously maintaining the stabilizer blades in their extended positions and for selectively retracting the stabilizer blades to their retracted positions while pivoting causing the lower part relative to pivot relative to the upper part to produce an axial bend in the tubular body and thereby tilt the drill bit out of alignment with the section of borehole being drilled.

23. Apparatus as defined in claim 22, wherein the upper and lower parts are pivotably connected together by a knuckle joint for producing the axial bend between the two parts.

24. Apparatus as defined in claim 22, further comprising:

biasing members for biasing the stabilizer blades radially inwardly; and camming surfaces on the mandrel for effecting radial movement of the stabilizer blades in response to axial movement of the mandrel relative to the tubular body.

25. Apparatus as defined in claim 22, wherein the mandrel further comprises:

a locking wedge member adapted to selectively lock the lower part in axial alignment with the upper part and to selectively permit tilting of the lower part by the actuating device.

26. Apparatus as defined in claim 22, further comprises:

locking means movable into an unlocking position in response to pressure variation in drilling fluid within the drill string to permit relative axial movement between the mandrel and the tubular body.

27. Apparatus as defined in claim 26, further comprising:

the mandrel including a bore for the passage of drilling fluid; and the locking means comprises at least one locking piston extending through a wall of the mandrel between the bore and an outer surface of the mandrel, and at least one locking recess in a wall of the tubular part for receiving the at least one locking piston in a locking position.

28. The method as defined in claim 27, further comprising:

returning the lower part to a position generally aligned with the upper part to eliminate the bend in the tubular body between the upper part and the lower part;

with the bend eliminated, extending the stabilizer blades radially outward and into engagement with the borehole wall; and rotating the drill bit while the upper and lower parts of the tubular body are axially aligned and while the stabilizer blades are extended radially outward to drill along substantially a straight path.

29. Apparatus for steering a drill bit at the end of a drill string within a borehole to permit drilling of the borehole along a deviated path, the apparatus comprising:

a tubular body having an upper part adapted at its upper end to be coupled to a lower portion of the drill string and a lower part adapted at its lower end to be coupled to a lower assembly including the drill bit, the lower part being pivotable relative to the upper part to produce an axial bend in the tubular body between the upper and lower parts;

a pivotable member for pivotably connecting the upper part and the lower part for selectively producing an axial bend between the two parts;

adjustable stabilizer blades mounted on the tubular body above the pivotable member and radially movable between extended positions in which the blades engage the borehole wall, and retracted positions in which the blades are radially spaced from the borehole wall; and an actuating member moveable to a blade in position for retracting the stabilizer blades to their retracted position while the two parts remain axially aligned, and further movable to a bend position for creating an axial bend between the two parts while the stabilizer blades remain retracted for drilling along a deviated path; and the actuating member movable to a straight path position for eliminating the axial bend while the stabilizer blades remain retracted, and further movable to a blade out positioned for expanding the stabilizer blades radially outward while the bend remains eliminated for drilling along a straight path.

30. Apparatus as defined in claim 29, further comprising:

the actuating member includes an axially movable mandrel having camming surfaces for effecting radial movement of the stabilizer blades in response to axial movement of the mandrel relative to the tubular body.

31. Apparatus as defined in claim 30, further comprising:

locking means movable into an unlocking position in response to pressure variation in drilling fluid within the drill string to permit relative axial movement between the mandrel and the tubular body.

32. Apparatus as defined in claim 29, further comprising:

the actuating member engaging the pivotable member while in the blade out position to effect tilting of the lower part relative to the upper part.

33. Apparatus as defined in claim 29, further comprising:

a plurality of near bit stabilizer blades mounted on the lower part of the tubular body between the pivotable member and the drill bit.

* * * * *